United States Patent [19]

Sutherland et al.

[11] 4,382,505

[45] May 10, 1983

[54] WRAP AROUND CARRIER FOR RETURNABLE BOTTLES

[75] Inventors: Robert L. Sutherland, Campbell Hall, N.Y.; George S. Holmes, Waldwick, N.J.

[73] Assignee: Federal Paper Board Company, Inc., Montvale, N.J.

[21] Appl. No.: 236,264

[22] Filed: Feb. 20, 1981

[51] Int. Cl.[3] ..... B65D 75/00; B65D 75/06; B65D 75/56; B65D 85/62

[52] U.S. Cl. ..... 206/180; 206/193; 206/434; 206/427; 229/52 BC; 229/28 BC

[58] Field of Search ..... 206/193, 434, 427, 180; 229/40, 52 BC, 28 BC

[56] References Cited

U.S. PATENT DOCUMENTS

| | | | |
|---|---|---|---|
| 3,181,727 | 5/1965 | Graser et al. | 229/40 |
| 3,258,152 | 6/1966 | Cameron | 206/193 |
| 3,294,280 | 12/1966 | Graser | 229/40 |
| 3,747,801 | 7/1973 | Graser | 206/193 |
| 4,278,168 | 7/1981 | Wood | 206/193 |

*Primary Examiner*—William T. Dixson, Jr.
*Attorney, Agent, or Firm*—August E. Roehrig, Jr.

[57] ABSTRACT

A wrap around carrier package for returnable beverage bottles is disclosed which is formed by wrapping about an assembly of the bottles which are arranged in double row and transversely paired relation, a cut and scored blank of foldable sheet material, so as to form a tubular configuration, having bottle retention means, and securing the end panels of the blank by interengaging locking and latching elements thereon with cooperating elements on the bottom margin of a center partition forming member which is disposed between the rows of bottles and which has a handle portion at its top margin, the handle portion being rendered accessible by tearing out a substantial portion of the top wall panel of the package so as to release the bottles for removal through the resulting top opening and permit return of the empty bottles, thereby converting the carrier to an open-top basket style carrier. In one form of the carrier, the center partition has hinged panels at its opposite ends which are adapted to be positioned so as to close the ends of the package.

11 Claims, 12 Drawing Figures

10
12
20
24
25
32
33
34
35
36
42
43
47
48
50
51
52
53
102
105
7
8

WRAP AROUND CARRIER FOR RETURNABLE BOTTLES

BACKGROUND OF THE INVENTION

This invention relates to packaging and is more particularly concerned with improvements in carrier type packages of beverage bottles, or similar products, which employ a flat blank wrapped about a group of the bottles, arranged in longitudinal and traverse alignment, so as to form a tubular container with provision for retaining the bottles against movement in the container and for enabling the bottles to be removed and permitting empty bottles to be returned to the container, without destroying the carrying capabilities of the container.

In the packaging of bottled and canned beverages, two types of carton or carrier structures have achieved extensive use in the beverage marketing industry, namely, the cellular basket type, which is particularly adaptable for multi-trip use with products in returnable bottles, and the single trip, disposable, wrap around type, which has been most often employed with products in non-returnable containers, particularly canned beverages since it employs less material and is more economical for one trip disposable use, than the basket type. Initially, the packaging of bottles in the wrap around blank presented a retention problem because of the bottle shape at the top. However, the provision of bottle retention apertures together with provision for a tight wrap solved that problem. Recently, there has been a demand for elimination of the disposable bottles which has resulted in the return to the marketing of beverages in the returnable bottles. This in turn has created a demand for some arrangement for inducing the consumer to return to the distributor both the disposable and non-disposable type for re-use or recycling. In response to such demands an effort has been made to develop a wrap around type package which will enable the bottles to be removed and replaced without mutilating the container to an extent which would render it unfit for the purpose of carrying the empty bottles on a return trip to the distributor.

It is a general object of the present invention, therefore, to provide a package adapted for the marketing of bottled products which can be formed by wrapping a blank of paperboard, or similar foldable sheet material, about a group of either disposable or returnable bottles so as to confine the bottles initially while permitting the consumer to remove a sufficient portion of the packaging material to readily remove the bottles from the package without destruction of its bottle retaining and carryiing capabilities and to permit the empty bottles to be placed therein for return to the distributor.

A more specific object of the invention is to provide a carrier type package for marketing bottled beverages, or other bottled products, which employ a blank of paperboard, or similar foldable sheet material, which is cut and scored so that it may be wrapped, in the form of a tubular container, about a group of the bottles, arranged in double row and transversely paired alignment, with provision for retaining the bottles against movement out of the container thus formed and for tearing away a portion of the top panel thereby enabling the bottles to be readily removed without destroying the bottle retaining and carrying characteristics of the carrying container and enabling the bottles, when emptied, to be replaced in the container for convenience in returning them to the distributor.

Another object of the invention is to provide a wrap around type bottle package with provision for restraining the bottles against accidental removal from the wrapper and with provision for tearing out a portion of the top wall of the package thereby enabling the ready removal and replacement of the bottles without destroying the container or carton forming characteristic of the wrapper and with the carton having therein a combination partition and handle construction which is interlocked with the bottom wall and separates the rows of bottles in the package and which is accessible when the top wall portion is torn out.

To this end, the invention as claimed herein is embodied in a package which employs a blank of paperboard, or other suitable foldable sheet or web material, which is cut and scored to enable it to be wrapped about a group of bottles which are arranged in double row, transversely paired and longitudinal alignment, with means for retaining the bottles in position in the tubular container formed by the wrapper and with a removable wall portion at the top for enabling bottles to be removed and replaced, and a partition and handle structure disposed in a vertical plane in the interior of the tubular carrying container which becomes accessible upon removing the top wall portion so as to maintain the carrying capabilities of the container.

The aforesaid objects and other objects and advantages of the invention will become more apparent when reference is made to the accompanying detailed description of the preferred embodiments of the invention which are set forth therein by way of example and shown in the accompanying drawings wherein like reference numerals indicate corresponding parts throughout.

DESCRIPTION OF THE PREFERRED FORM OF THE INVENTION

Figures 1, 2, 3:
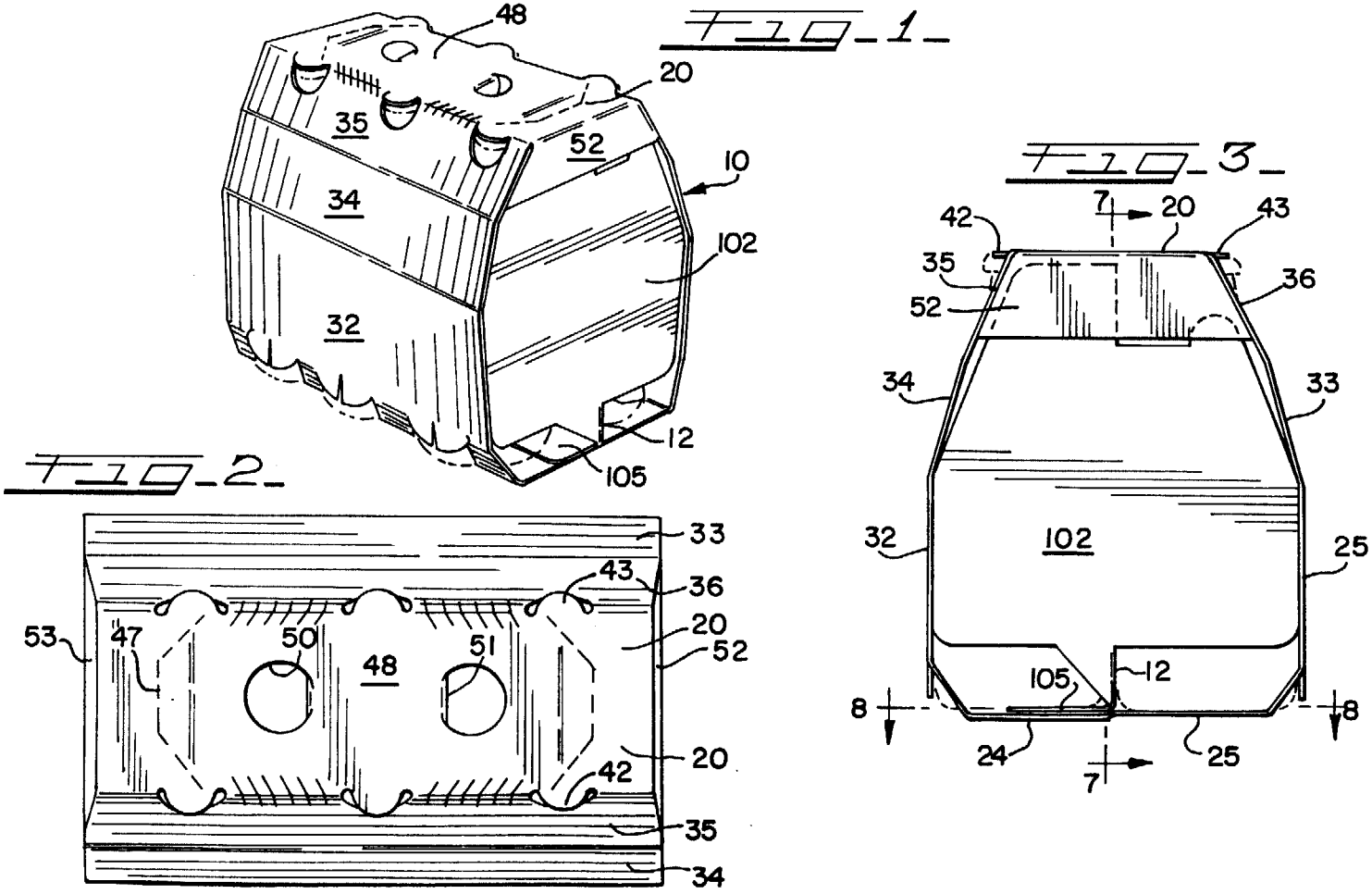
FIG. 1 is a perspective view of a set-up bottle carrier type package with bottles shown therein in phantom lines, which embodies the principles of the invention.
FIG. 2 is a top plan view of the package of FIG. 1 to a larger scale.
FIG. 3 is an end view of the package of FIG. 1 to a larger scale.
Figure 9:
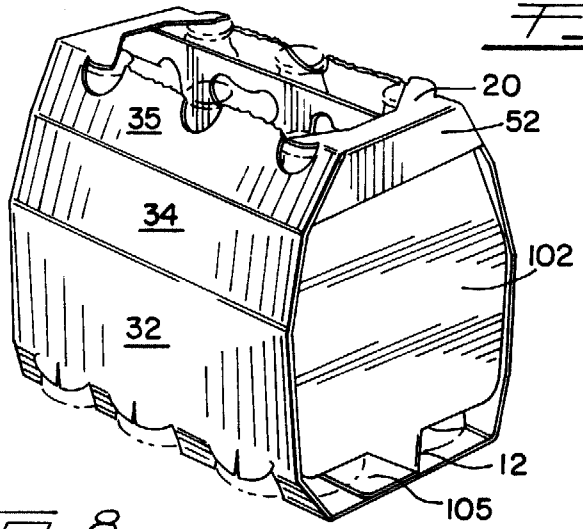
FIG. 9 is a perspective view of the package of FIG. 1 with the tear out portion of the top wall removed.

Referring to the drawings there is illustrated in FIG. 1 a carrier package 10 for an assembly of six beer bottles "B" with the bottles arranged in double row and transversely paired relation and the rows separated by a handle and partition forming structure 12 which includes end closure panels for the package so as to protect the product against light induced deterioration. The package 10 which embodies the principle features of the invention is formed by folding about the assembly of bottles "B" and the partition and handle forming structure 12, a cut and scored paperboard blank 14 (FIG. 10) and connecting the ends of the blank 14 to form a tubular wrap around carrier, carton or container which encloses the bottles "B" and the partition and handle structure 12 with the handle forming top portion of the latter being inaccessible when the package is initially formed. A top wall forming panel of the carrier has a tear-out section which is removed and discarded so as to permit removal of bottles through the resulting top opening (FIG. 9) and to provide access to the handle forming top portion of the panel structure 12 for carrying when the empty bottles are returned to the carton.

Figure 10:
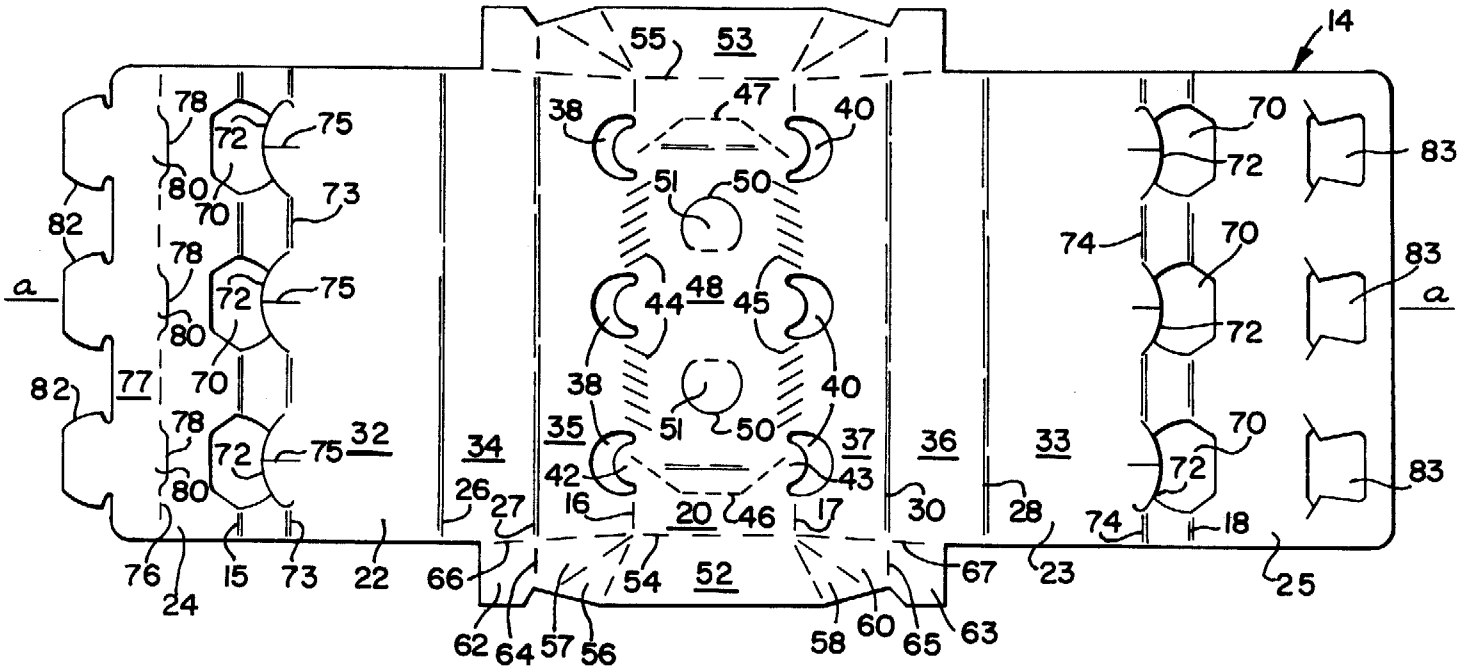
FIG. 10 is a plan view of a paperboard blank which is cut and scored to form the tubular carton for the package of FIG. 1.

The blank 14 comprises an elongate paperboard sheet, or other suitable foldable sheet material, which is cut and scored as shown in FIG. 10. The blank 14 is symmetrical about a longitudinal extending center line a—a and is divided by parallel, longitudinally spaced score lines 15, 16, 17 and 18 which extend transversely of the blank, into a top wall forming center panel section 20, adjoining side wall forming sections 22 and 23 and bottom wall forming panel sections 24 and 25, the last mentioned being at opposite end margins of the blank 14. The side wall forming panel sections 23 and 24 are subdivided by pairs of transversely extending score lines 26, 27 and 28, 30. These lines are parallel with and spaced from the transverse score lines 15 and 18. The score lines defining each of the pairs of these score lines 26, 27 and 28, 30 are spaced apart on equal distance and the lines 26 and 28 are spaced an equal distance from the score lines 16 and 17 which define the top wall panel 20. The score lines 26 and 27 divide the side wall panel section 22 into a bottom side wall forming panel 32 and two equal top side wall forming panels 34 and 35. The opposite side wall panel section 23 is divided in like manner by the score lines 28 and 30 into a bottom side wall panel 33 and top side wall panels 36 and 37. The dimension of the top wall forming panel 20 in the direction longitudinally of the blank is less than the distance between the outside edges of the caps on a pair of transversely aligned bottles "B," which distance is less than the transverse distance at the bottom of the bottles with the result that the top side wall panels 34, 35 and 36, 37 are slanted toward each other when the wrapper is assembled about a group of bottles, the score lines 26, 27 and 28, 30 being located so that the side wall forming panels follow or generally conform to the upward slant of the bottle surfaces at the upper portion of the bottles, that is, the portions extending from the main portion of the bottle body to the neck portion thereof. The dimensions, in the longitudinal direction of the blank, of the bottom side wall portions 32 and 33 correspond generally to the height of the main body portions of the bottles "B". The width of the transverse dimension of the major portion of the blank 14 corresponds approximately to the bottom dimension of the rows of the bottles "B" when grouped as shown, so that when the wrapper 14 is wrapped about the group of bottles it takes the form of an open ended tube with provision for restraining the bottles against removal out of the ends of the tube.

Figure 4:
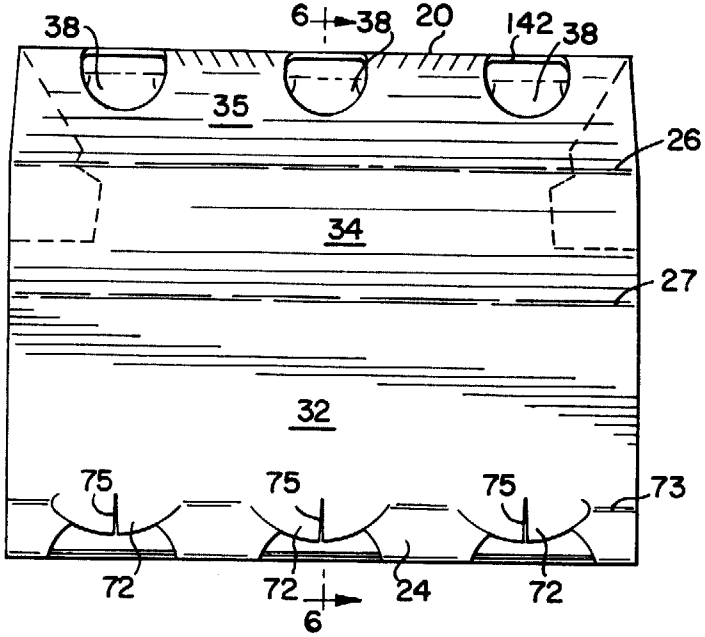
FIG. 4 is a side elevation of the package of FIG. 1.
Figure 7:
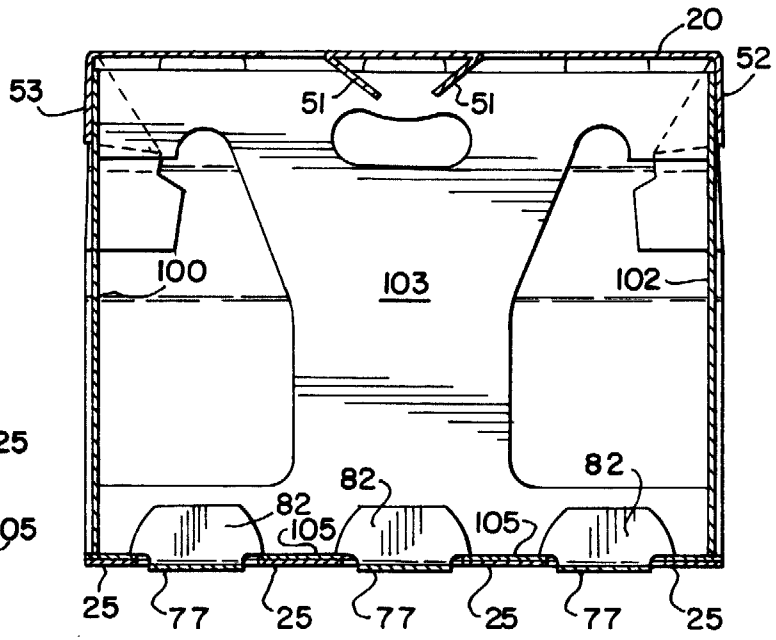
FIG. 7 is a longitudinal sectional view taken on line 7—7 of FIG. 3.

The restraining means for the tops of the bottles comprises two spaced sets or lines of cresent shaped apertures 38 and 40 which are spaced transversely of the blank according to the spacing of the bottles. The apertures 38 and 40 are cut in the panels 35 and 37 and interrupt the score lines 16 and 17 which define the top edges of the package and the side edges of the top wall panel 20. The apertures 38 and 40 are cut so as to leave small tabs 42 and 43 which, when the blank is folded about the bottles, remain in the plane of the top wall panel 20 and cover the outside margins of the bottle caps. The portions 44 and 45 of the transverse score lines 16 and 17 which extend between the apertures 38 and between the apertures 40 are slit or perforated so as to constitute tearing lines. Panel 20 is perforated or slit on the inwardly opening, generally U-shaped lines 46 and 47 which extend in the material between the end pairs of the apertures 38 and 40 so as to define with the tear lines 44 and 45 a tear-out panel 48 which, when the material is removed, will result in a top opening for removal of the bottles B. The panel 48 is provided with a pair of spaced finger apertures by cutting and scoring on the lines 50 so as to define tabs 51 which are adapted to be hinged inwardly into the space between the bottles and reinforce the finger accomodating apertures, for carrying the package initially. A futher restraining means for the tops of the end most pairs of bottles which serve a dual purpose, as hereinafter described, is provided by relatively narrow panels 52 and 53 in opposite side margins of the blank. The panels 52 and 53 are separated from the panel 20 by longitudinally extending hinge score lines 54 and 55 which are offset inwardly a slight distance from the side edges of the end sections of the blank. The panels 52 and 53 are joined at their opposite ends to the adjoining side wall panels 34, 35 and 36, 37 by triangular web panels 56, 57 and 58, 60 which are in turn connected to small rectangular panels 62 and 63. The small panels 62 and 63 are separated from the web panels by score lines 64 and 65 constituting extensions of the transverse score lines 27 and 30, and the associated panels 56, 57, 62 and 48, 60, 63 are separated from the panels 35, 34 and 37, 36 by hinge score lines 66 and 67 extending from the ends of the score lines 20 to junctures with the edges of the blank at points intermediate the score lines 26, 27 and 28, 30. In the set up position of the carrier, the webs 56, 57 and 58, 60 and their associated panels 62 and 63 are folded so as to lie on the inside faces of the side wall panels 34, 35 and 36, 37 (FIGS. 4 and 7).

The lower side wall forming panels 32 and 33 are provided with a series of apertures 70 of identical configuration which are spaced transversely of the blank in accordance with the spacing of the bottles in the length wise rows. The apertures 70 interrupt the bottom folded or hinge forming score lines 15 and 18 and extend a short distance into the bottom wall forming panels 24 and 25. The innermost edges of the apertures 70 which become the uppermost edges in the set up carton are defined by curved cutting lines 72 which buldge or bow into the apertures 70 with their ends terminating at transverse score lines 73 and 74 which score lines 73 and 74 are spaced, in the direction of the center of the blank, from the score lines 15 and 18 and the small portions of the panels 32 and 33 thus formed are split by short longitudinally extending cuts 75. The apertures 70 are adapted to receive portions of the heels of the bottles in the final package 10 so as to hold the bottles at the bottom against movement in the tightly wrapped package. The apertures 70 and associated elements may be formed as shown in U.S. Pat. No. 3,589,593 granted to Arthur J. Weiss on June 29, 1971 and No. 3,977,518 granted to Edwin L. Arneson on Aug. 31, 1976.

The bottom wall forming panels 24 and 25 at the end margins of the blank 14 are provided with locking and latching means in the end marginal portions which are adapted to be overlapped and secured beneath the bottom of the bottle assembly in wrapping the cut and scored blank about the assembly of bottles so as to form the package 10. The panel 24, which has its end marginal portion outermost when the panels 24 and 25 are connected to form the carrier bottom panel assembly, is scored on a transverse line 76 to provide a relatively narrow male locking panel 77 on the blank end margin. The score line 76 is spaced from the end edge of the blank and is interrupted by a series of transversely spaced cutting line formations 78, each of the latter extending into the main body of the panel 24 so as to provide primary locking tab members 80. A series of latching fingers 82, having enlarged heads and reduced neck portions, are formed on the blank end margin in longitudinal alignment with the locking tab members 80. The bottom wall forming panel 25 at the opposite end of the blank which serves as the female locking panel, is provided along is free margin with a series of locking apertures 83 for receiving the locking tabs 80 and the latching fingers 82. The locking apertures 83 are transversely spaced in accordance with the spacing of the locking and latching elements 80 and 82 so as to cooperate therewith in securing the panels 23 and 24 in connected relation. The arrangement of the locking and latching elements may be the same as the arrangement of the corresponding elements described in aforesaid patent No. 3,589,593 or as described in U.S. Pat. No. 3,556,386 granted to Robert H. Ganz on Jan. 16, 1971.

Figure 6:
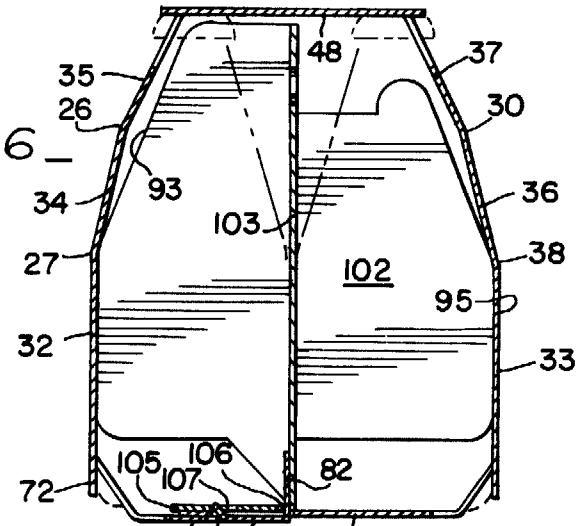
FIG. 6 is a cross-sectional view taken on the line 6—6 of FIG. 4.
Figure 5:
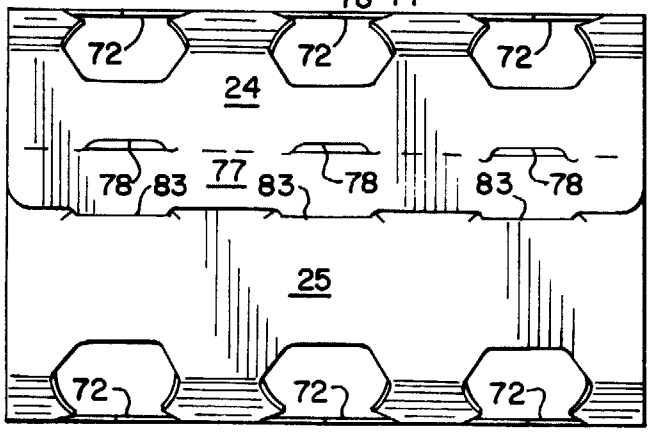
FIG. 5 is a bottom plan view of the package of FIG. 1.
Figure 8:
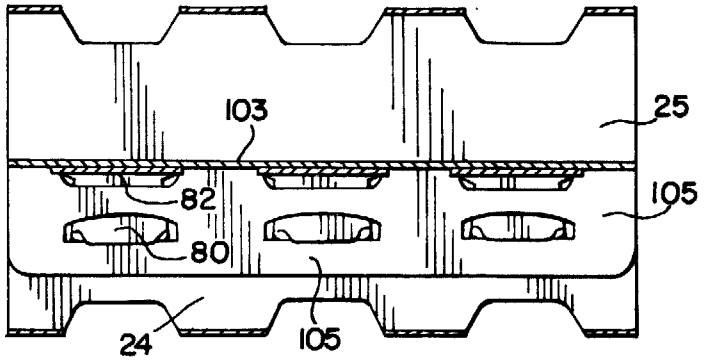
FIG. 8 is a longitudinal sectional view taken on the line 8—8 of FIG. 3.
Figure 11:
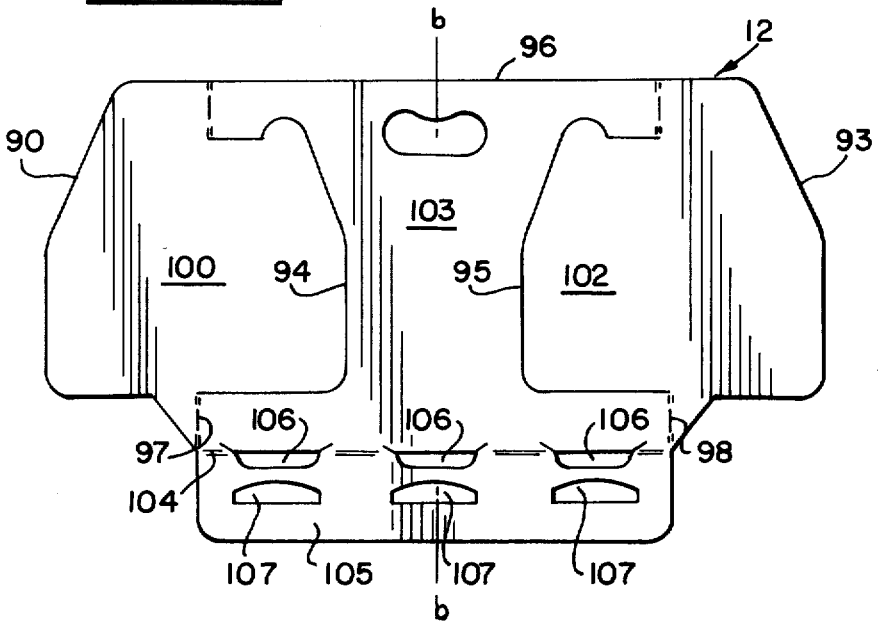
FIG. 11 is a plan view of a blank which is cut and scored to provide the handle and partition structure for the package of FIG. 1.

The partition and handle structure 12 is formed from a generally rectangular sheet of paperboard which is cut and scored as shown in FIG. 11. The cut and scored blank 12 is symmetrical about the vertical center line b—b and is cut on its opposite end edges 90 and 93 to correspond approximately to the configuration of the end edge of a side wall as viewed at the end of the package (FIG. 3). The blank is cut on the generally U-shaped lines 94, 95 which are spaced inwardly of the edge defining lines 90 and 93, which cutting lines are mirror images of the edge cutting lines 90 and 93 with a configuration corresponding to major portions of the edge lines 90 and 93. Cutting lines 90 and 94 are spaced equal distance from a hinge score line 97 at the top and bottom while cutting lines 93 and 95 are spaced in the same manner from the hinge-score line 98. The hinge score lines 97 and 98 are spaced equal distances from the end edge lines 90 and 93 and they are spaced apart a distance corresponding to approximately the overall length of the row of the bottles and the transverse dimensions of the side wall forming panels 32 and 33 in the blank 14 so that when the end panels 100 and 102 are swung about the hinge lines 97, 98 into planes normal to the plane of the center portion 103 of the blank, they will serve as end panels for the package and substantially close the greater portion of the openings in the ends of the carton formed around the bottles. A longitudinal hinge score line 104 extends between the bottom end edges of the score lines 97, 98 and which defines the bottom forming edge of the row separating partition panel 103 when incorporated in the package. A relatively narrow panel 105 extends along the side of the blank which is separated from the panel 103 by the score line 104 and is adapted to be hinged on the line 104 so as to lie on the overlapped portions of the bottom wall forming panels 24 and 25 (FIGS. 3, 6, 8 and 9). Two lines or rows of small apertures 106 and 107 are provided in the panel 105. Each of the apertures 106 interrupts the hinge score line 104 and extends into panel 105, with the spacing being such that the apertures 106 will be aligned with the latching elements 82 while the apertures 107 will be aligned with the primary locking elements 80 (FIGS. 5, 7 and 8) in the set up carton. The apertures 106 and 107 are dimensioned and spaced so as to receive in locking and latching relation the locking and latching members 80 and 82 (FIGS. 6 and 8). The panel 105 serves to connect the handle and partition structure 12 to the bottom wall of the carton and also reinforces the latter. The depth of the panel 103, that is, the dimension between the top edge line 96 and the bottom hinge line 104, is slightly less than the distance between the top and bottom walls of the set up carrier (FIGS. 6 and 7). Panel 102 is provided with a handle hole 108 spaced below the top edge 96 and intermediate side edges of the panel.

In forming the package, the bottles "B" are assembled in a group of six in double row transversely spaced relation and the handle and partition panel assembly 12 is inserted between the bottle rows with the top edge 96 of the partition panel 103 slightly below the plane of the top faces of the bottle caps and with the end wall forming panels 100 and 102 turned into end wall forming position. The cut and scored carton forming blank 12 is positioned on the top of the assembly and the side wall formations 22 and 23 are folded down and around the opposite sides of the bottle assembly. The end panels 52 and 53 on the top wall panel 20 and the associated web panels are folded inwardly so that the panels 52 and 53 cover the top portions of the end wall panels 100 and 102 as shown in FIGS. 1, 3, 6 and 9. The one bottom wall panel 25 is turned inwardly and the bottom panel 105 on the partition is swung with the wall panel 25 into a horizontal plane beneath the one row of bottles. The wall forming panel 24 is swung inwardly with locking panel 77 being turned downwardly into a vertical plane so as to align the locking elements 80 for entry into apertures 83 and the aligned apertures 107 as panel 24 is brought into wall forming position. The locking panel 77 is manipulated to insert the locking elements 82 in the aligned apertures 83 and 106 (FIG. 6). In manipulating the locking panel 77 the locking elements 80 bear against the innermost edges of the cooperating locking apertures 83 with the latter forming a fulcrum for drawing the bottom wall panels 24 and 25 toward each other so as to tightly draw the entire walls arond the bottle assembly. Tension in the wall panels for obtaining a tightly wrapped package and drawing the bottom wall panels into position for locking the same may be obtained by application of external side pressure, for example, as shown in U.S. Patents granted to R. H. Ganz U.S. Pat. No. 3,456,420 dated July 22, 1969 and U.S. Pat. No. 3,474,590 dated Oct. 28, 1969.

In using the package the bottles are initially enclosed by folding the wrapper 14 about the same as described.

In using the product, access may be had to the bottles by tearing out the top wall panel 48 which will free all of the bottles for removal through the top of the carton or carrier. This also provides access to the hand hole 108 in the handle portion of the partition assembly 12 which is anchored to the bottom wall so as to facilitate carrying the package when the empty bottles are replaced therein for return to the point of purchase.

Figure 12:
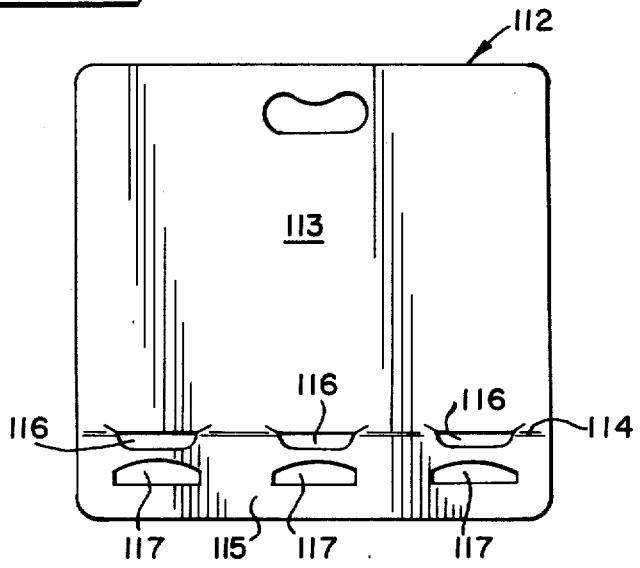
FIG. 12 is a plan view of a modified partition and handle structure.

The form of the carrier shown in FIGS. 1 to 10 is provided with the handle and partition forming blank shown in FIG. 11 which includes the end wall forming panels 100 and 102 which are designed to protect bottled beer, or the like, against deterioration due to exposure to excessive light. However, the package may be modified, if desired, by employiing the partition and handle structure 112 shown in FIG. 12 in which the end wall forming panels are omitted. The partition and handle structure panel 112 which includes the handle and partition forming panel 113 and hinged bottom anchoring panel 115 which is divided from the panel 113 by hinge-score line 114. The panel 115 is provided with two lines of apertures 116 and 117 which are of the same character as the apertures 106 and 107 in the partition assembly 12 and are employed for the same purpose to anchor the partition to the bottom wall of the carrier carton.

The partition assembly 112 may be provided with so-called "butterfly" panels for hinging into planes normal to the plane of the body of the partition panel so as to lie between the bottles in the two rows when it is desired to comply with railroad shipping requirements.

What is claimed:

1. A carton for packaging an assembly of articles in the form of bottles arranged in double row, transversely aligned pairs, said carton being in the form of a tube of foldable sheet material with connected wall-forming panels which are adapted to be disposed about the top, sides and bottom of the articles when the assembly of articles is enclosed in the carton, said carton having means for restraining the articles against movement out of the ends of the carton, the top wall forming panels of said carton having tear lines defining a tear out portion of sufficient size to enable the articles to be readily removed through the resulting opening while retaining the tubular configuration of the carton and permitting return therein of articles of like form, the carton bottom wall comprising a pair of marginally overlapped panels which are secured by cooperating interengaging locking elements, and a separate insertable partition member adapted to be positioned between the two rows of articles which has means at the bottom for interlocking with the overlapped marginal portions of said bottom wall forming panels and a handle forming means adjacent the top which is accessible through the opening resulting from tearing out said portion of said top wall forming panel.

2. A carton as set forth in claim 1 wherein said carton bottom wall comprises a pair of marginally overlapped panels which are secured by said interengaging locking elements in inwardly drawn tight relation so as to form a tightly wrapped article assembly.

3. A carton as set forth in claim 1 wherein said carton bottom wall panel securing locking elements are in the overlapped marginal portions of said bottom wall forming panels.

4. A carton as set forth in claim 1 wherein said means for restraining the articles against movement comprises openings at the juncture of the top and side wall forming panels, and wherein said tear lines extend between said openings so as to enable a major portion of said top wall forming panel to be torn out and thereby provide an opening for removal and return of the articles which leaves end portions of the top wall forming panel intact so as to substantially maintain the carton in its original tubular configuration.

5. A carton as set forth in claim 1 wherein said top wall forming panel has hingedly connected relatively narrow end panels at its opposite ends which are adapted to be hinged to a position to close top portions of the ends of the tubular carton, said end panels being connected by foldable web panels at opposite ends to the top portions of the sidewall forming panels and said web panels being folded so as to lie against the inner faces of the side wall panels.

6. A carton as set forth in claim 1 wherein said interengaging locking elements for securing said bottom wall panels comprise locking and latching tab elements on the margin of one of said pair of panels and cooperating locking and latching apertures in the margin of the other one of said pair of panels, said latching tab elements and the cooperating latching apertures being disposed so that said latching tab elements, when engaged in said cooperating apertures, will be in upstanding relation between pairs of transversely aligned articles.

7. A carton as set forth in claim 6 wherein said latching tabs will lie along a bottom portion of said partition member.

8. A carton as set forth in claim 1 wherein said partition member has a hingedly connected panel at the bottom which is disposed in overlying relation on the overlapped margins of said bottom wall forming panels.

9. A carton as set forth in claim 1 wherein said partition member has a hingedly connected bottom panel which is disposed so as to lie on the inside face of the bottom wall and includes said means for interlocking with said bottom wall forming panels.

10. A carton as set forth in claim 9 wherein said means for interlocking with said bottom wall forming panels comprising locking and latching apertures in said hingedly connected bottom panel of said partition member.

11. A carton as set forth in claim 1 wherein said partition member has a relatively narrow hinged panel on its bottom edge which is disposed to lie on the overlapped margins of said bottom wall forming panels and which has locking and latching tab elements on the bottom wall forming panels.

* * * * *